US006313757B1

(12) United States Patent
Braun

(10) Patent No.: US 6,313,757 B1
(45) Date of Patent: Nov. 6, 2001

(54) METHOD AND APPARATUS FOR CONTROLLING MOTOR VEHICLE TRAFFIC

(75) Inventor: Hans-Joachim Braun, Alling (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/261,186

(22) Filed: Mar. 3, 1999

(30) Foreign Application Priority Data

Mar. 5, 1998 (DE) ..... 198 09 430

(51) Int. Cl.[7] ..... G08G 1/07
(52) U.S. Cl. ..... 340/917; 340/905; 340/911
(58) Field of Search ..... 340/439, 905, 340/917, 933, 934, 911; 701/117, 118

(56) References Cited

U.S. PATENT DOCUMENTS 3,660,812 5/1972 Inose et al. ..... 310/911
4,370,718 * 1/1983 Chasek ..... 340/911
5,257,194 10/1993 Sakita ..... 504/192
5,646,853 * 7/1997 Takahashi et al. ..... 340/911
5,696,502 * 12/1997 Busch et al. ..... 340/905
5,822,712 * 10/1998 Olsson ..... 340/934

* cited by examiner

*Primary Examiner*—Van T Trieu
(74) *Attorney, Agent, or Firm*—Schiff Hardin & Waite

(57) ABSTRACT

Control logics for the traffic-dependent controlling of traffic signal installations (1) are described with flow diagrams that become increasingly difficult to understand as phase sequences become more complex, and can only with difficulty be converted, in automated fashion, into traffic-oriented descriptions for signal programs. In a database data file (15), conditional equations (B1, B2, B3) that compare traffic-oriented characteristic quantities with predetermined threshold values are stored together with actions (A1, A2, A3, A4) for exchanging signal programs and together with rules (R1, R2, R3, R4). The rules (R1, R2, R3, R4) have control values and action directions (X). The control values are compared with truth values of the conditional equations, and, given complete agreement between the control values of a particular rule and the truth values, the action (A1, A2, A3, A4) to which the action indication (X) of the particular rule (R1, R2, R3, R4) refers is executed.

15 Claims, 2 Drawing Sheets

15
DATA FILE

| | S3 | R1 | R2 | R3 | R4 |
|---|---|---|---|---|---|
| B1 | b1 AND b2 AND b3 AND b4 | J | N | N | N |
| B2 | b1 AND b2 | — | J | N | N |
| B3 | b3 AND b4 | — | — | J | N |
| A1 | S5 | X | | | |
| A2 | S3 | | X | | |
| A3 | S4 | | | X | |
| A4 | S2 | | | | X |
| V | | E | E | E | E |

15 DATA FILE

| | S3 | R1 | R2 | R3 | R4 |
|---|---|---|---|---|---|
| B1 | b1 AND b2 AND b3 AND b4 | J | N | N | N |
| B2 | b1 AND b2 | — | J | N | N |
| B3 | b3 AND b4 | — | — | J | N |
| A1 | S5 | X | | | |
| A2 | S3 | | X | | |
| A3 | S4 | | | X | |
| A4 | S2 | | | | X |
| V | | E | E | E | E |

METHOD AND APPARATUS FOR CONTROLLING MOTOR VEHICLE TRAFFIC

BACKGROUND OF THE INVENTION

The present invention relates to a method and apparatus for traffic-dependent controlling of means for controlling traffic.

Traffic-dependent traffic controlling takes place today for example via traffic signal installations, alternating traffic signs, changeable parking space information signs or radio announcements. The traffic-dependent data is obtained via traffic detectors such as induction loops, radar detectors, or infrared detectors.

For example, given traffic signal installations as means for controlling traffic, the phase sequences or signal sequences thereof are determined by predetermined signal programs. The signal programs can thereby be varied according to the selected control method. Thus, in traffic-dependent control methods, e.g. the time duration of the individual phases, the sequence of the individual phases and the number of different phases (given need-related requests) in the signal program are changed. In time-of-day-dependent control methods, different signal programs, and thus different phase sequences, are switched at fixedly predetermined times of day (e.g. in peak traffic hours).

For the selection of the signal program or, respectively, for the selection of the phase duration, the sequence of phases or the number of phases, traffic-related characteristic quantities are evaluated that are determined using the traffic detectors. In the case of a signal program with fixed times, the characteristic quantities are converted off-line during the design processing. In the case of a signal program adaptation or signal program formation, the characteristic quantities are processed continuously, with the possibility of a controlling alternating between traffic flow and signal controlling. The momentary signal programs are thereby calculated on-line and evaluated according to a predetermined control logic, on the basis of respectively updated characteristic quantities. With the aid of traffic detectors, occupation values are detected in the spatial surroundings of the traffic signal installations, from which values characteristic quantities of the traffic flow are derived. Characteristic quantities include for example the wait time of the vehicles at the traffic signal installation, the length of the traffic queue at the traffic signal installation, the traffic heaviness, i.e. vehicles per cross-section, travel speed, signaling (request) by pedestrians, cyclists and/or vehicles, degree of occupation, traffic density, degree of capacity utilization and the load quotient. Given a traffic-dependent signal program selection, the prepared characteristic quantities of the traffic flow are combined in the control logic for the selection of the signal programs with conditional equations and threshold values.

From the reference "Richtlinien für Lichtsignalanlagen" ((RiLSA)—Lichtzeichenanlagen für den Straβenverkehr—ed. 1992, published by the Forschungsgesellschaft für Straβen- und Verkehrswesen, Arbeitsgruppe Verkehrsführung und Verkehrssicherheit, pp. 46 to 47, as well as Appendix D, pp. 90 to 110), it is known how control logics are represented using flow diagrams. The phases and phase sequences of the traffic signal installation that are useful for the traffic-dependent controlling are thereby shown in a phase sequence plan. The exchange between the phases is defined precisely and is shown in comprehensible fashion in the phase transition. A flow diagram contains the logical and chronological conditions for the duration of the phases and for the switching of the phase transitions, and thus completely represents the sequence of the traffic-dependent controlling. Logical conditions thereby hold for the combination of the characteristic quantities of the traffic flow, and chronological conditions predetermine the chronological context of the program sequences, such as for example minimal and maximal clearance times of a signal group given free circulation time. Only a single flow diagram is thereby to be represented for all signal programs. This single flow diagram becomes increasingly difficult to understand as the complexity of the control logic increases, and a translation of the conditions prescribed in the flow diagram into a traffic-oriented description that a control apparatus of a traffic signal installation can interpret becomes increasingly difficult.

SUMMARY OF THE INVENTION

It is an object of the present invention to provide a method and apparatus for traffic-dependent controlling of means for controlling traffic, which are constructed so as to be able to be adapted to new traffic conditions with a low expense, and which permit simple conversion into a traffic-oriented specification.

In a common database data file there are stored the conditional equations, as well as actions that are to be executed upon a transition, located within a predetermined context, of a momentary state into an updated state better adapted to the momentary traffic flow, and rules that combine the conditional equations and the actions with one another. By means of this common storing in a predetermined database format, there results both an easily surveyable representation and also a common format for various changes between states.

In a preferred construction of the method, several database data files are combined with one another in order flexibly to handle complex sequences.

According to another embodiment, it is advantageously provided that fixed control hierarchies are constructed by means of predetermined processing sequences of various database data files.

The construction according to a further embodiment is particularly flexible, according to which the control hierarchies can be modified, in that within the database data files reference is made to database data files that do not follow directly in the processing sequence.

The method can advantageously be adapted to traffic conditions changed in this way, which can be taken into account only by means of a adaptation and/or selection of the control program located outside the predetermined context. The adaptation takes place in that the conditional equations, the rules and/or the actions of the database data files are modified and stored.

The method according to another embodiment can be adapted particularly well to the traffic conditions in that within the actions calculations are carried out whose results are taken into account in subsequent database data files of a processing sequence.

For traffic signal installations as means for controlling traffic, the momentary signal sequence (momentary signal program) as a momentary state is advantageously replaced by a further signal sequence (further signal program) as an updated state.

For traffic management systems as means for controlling traffic, the momentary control strategy as a momentary state is advantageously replaced by a further control strategy as an updated state.

The structure common to all database data files permits an implementation of the determination, described in the database data file, of the current control program by means of an algorithm that is common for all database data files.

A combination direction allocated to the actions is provided that, after the execution of the action, refers to a further database data file, in order advantageously to obtain, by means of a combination of database data files, an apparatus that is to be used flexibly for various traffic sequences.

In a further advantageous construction, in the database data files a combination direction to further database data files is contained, independent of the executed actions, whereby a fixed processing hierarchy of the database data files among themselves is achieved.

By means of the assembling of conditional equations by means of logical combinations of individual conditions and the logical combination thereof, complex control conditions can be combined in an easily surveyable, flexible manner.

For traffic signal installations as means for controlling traffic, the momentary signal sequence as a momentary state is advantageously replaced by a further signal sequence as an updated state.

For traffic management systems as means for controlling traffic, the momentary control strategy as a momentary state is replaced by a further control strategy as an updated state.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several figures of which like reference numerals identify like elements, and in which:

DESCRIPTION OF THE PREFERRED EMBODIMENTS

Figure 1:
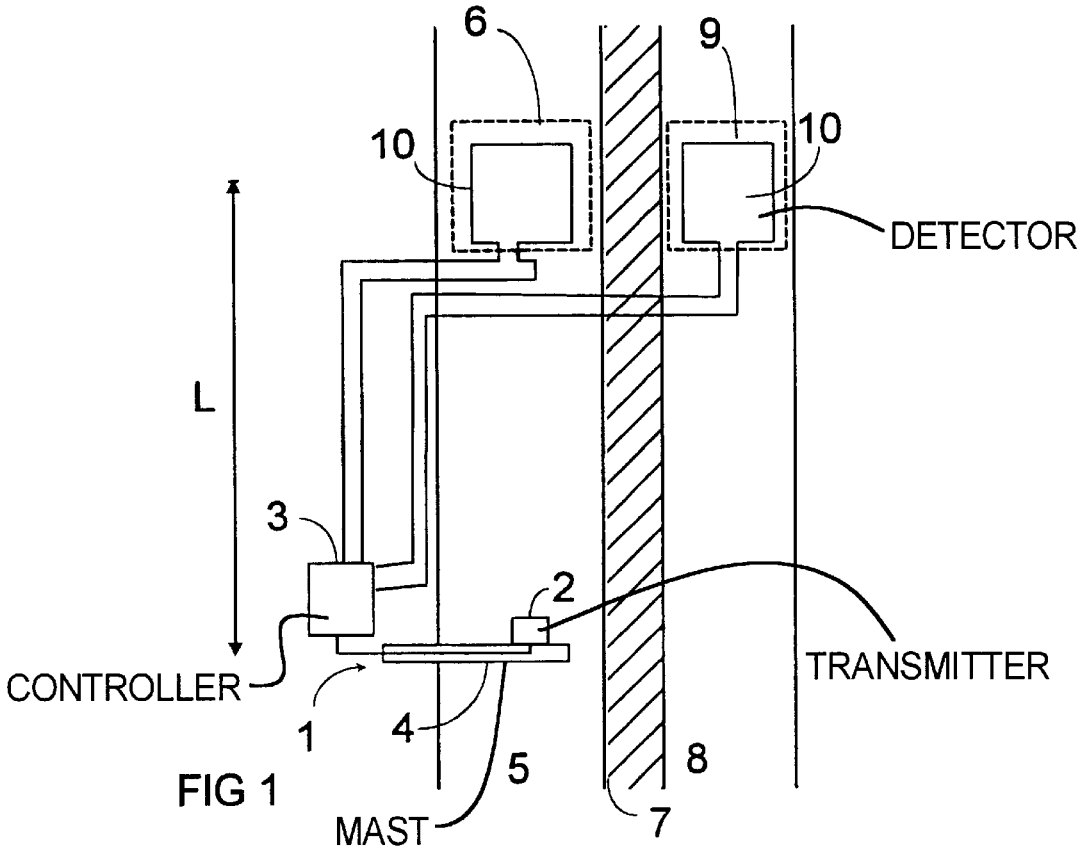
FIG. 1 thereby schematically shows the construction of a traffic signal installation with traffic detectors.

FIG. 1 shows a traffic signal installation 1 as an example of a means for controlling traffic. The method is also suited for alternating traffic signs, parking space information signs, or for determining detour measures or automatic radio announcements, as well as for money exchange are additional control strategies in traffic management systems.

In the traffic signal installation 1, two light signal transmitters 2 are controlled via a control apparatus 3, whereby the cable connections are arranged within a whip mast 4, which serves at the same time as a fastening means for the light signal transmitters 2. With the light signal transmitters 2, the traffic is regulated on a first traffic lane 5 (e.g. into the city), which lane is divided from a second traffic lane 8 in the opposite direction (e.g. leaving the city) by a center stripe 7. Two traffic detectors 10, e.g. inductive loops, record occupation values of vehicles in a first measurement cross-section 6 on the first traffic lane 5 and in a second measurement cross-section 9 of the second traffic lane 7, and send them to the control device 3, in which characteristic quantities of the traffic flow on the first traffic lane 5 and the second traffic lane 8 are determined therefrom. With the aid of the determined characteristic quantities, the momentarily switched signal sequences (momentary signal program, momentary state) within the control device 3 are evaluated on the basis of the momentary traffic flow, and, by means of a control program in the control device 3, if necessary a further signal sequence (further signal program, updated state) suited for the momentary traffic sequence is determined with which the traffic signal installation 1 is subsequently operated in order to achieve an improved traffic flow. Given traffic management systems as means for controlling traffic, momentary strategies as momentary states are analogously replaced by further control strategies that are better suited to the momentary traffic situation.

Figure 2:
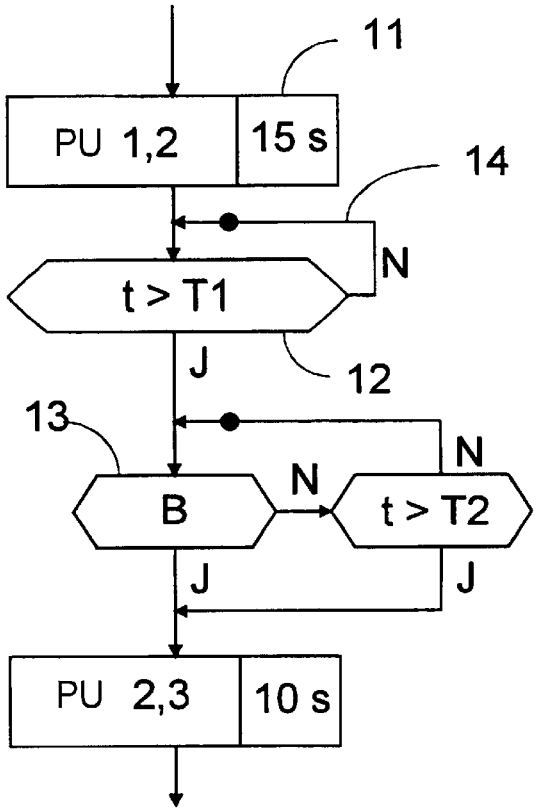
FIG. 2 shows a schematic flow plan as used in the prior art for the control logic.

FIG. 2 shows a conventional flow diagram for the transition of a phase 1 into a phase 2, and from the phase 2 into a phase 3, whereby in phase 2 the vehicles on the first traffic lane 5 receive a clearance signal. The phase transition PU 1,2 from phase 1 to phase 2 thereby lasts 15 s, as is shown in an action element 11. During phase 2, the time t, which elapses from the phase transition to phase 2, is measured, and is compared with the shortest time duration T1 of the phase 2, as shown in a decision element 12 for chronological conditions. As long as the chronological conditional equation that the elapsed time t is greater than the shortest time duration T1 receives the truth value 'false' or 'no N,' waiting takes place in a time loop 14. The process continues only when the conditional equation, that the elapsed time t be greater than the shortest time duration T1, receives the truth value 'true' or 'yes Y.' For an adaptation of the clearance time in phase 2 that meets the requirements, in this example it is checked, in a logical conditional equation B, whether the time gap between two successive vehicles detected by the vehicle sensor 10 is greater than a given predetermined time, e.g. 2.5 s. This logical conditional equation B1 is shown schematically in a decision element 13 for logical conditions. If this logical conditional equation receives the truth value 'true Y,' then on the basis of the low traffic density resulting therefrom the transition PU 2,3 is carried out from phase 2 into a phase 3, whereby the transition lasts 10 s. If the logical conditional equation B1 receives the truth value 'false N,' then it is checked whether the elapsed time t since the phase transition to phase 2 is already greater than the longest time duration T2 of phase 2. If this second chronological conditional equation receives the truth value 'true Y,' then the phase transition PU 2,3 from phase 2 to phase 3 is likewise introduced. If this second chronological conditional equation receives the truth value 'false N,' then in a further time loop, in a next time step, the logical conditional equation B1 is again evaluated. For traffic signal installations that are more complex than described in this example, the flow diagram rapidly becomes difficult to understand, difficult to modify, and difficult to implement automatically into a traffic-oriented description that can be used in the control program of the control device 3.

Analogously to the described transition between two phases, transitions between different signal programs are also shown dependent on the characteristics of the traffic flow.

Figures 3, 4:
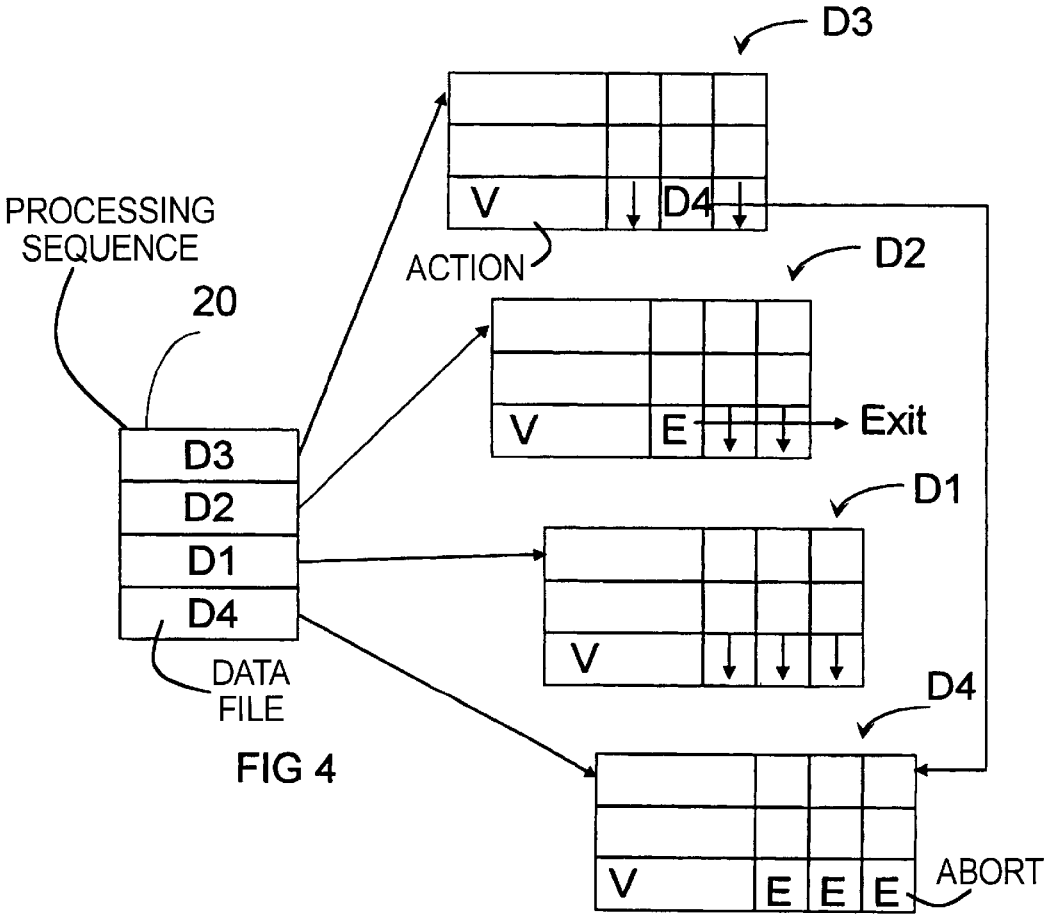
FIG. 3 schematically shows the construction of an inventive database data file with conditional equations, rules and actions.
FIG. 4 schematically shows a processing sequence of several database data files.

For the specification of the inventive solution, in FIG. 3 it is assumed that a separate signal program is available for each of five different traffic situations. These are the following: a first situation S1: low traffic; a second situation S2: daytime traffic; a third situation S3: peak traffic into the city;

a fourth situation S4: peak traffic away from the city; a fifth situation S5: balanced peak traffic. For the description of the traffic flow, individual conditions are used that place the determined characteristic quantities into relation with predetermined threshold values. In this example, the individual conditions are thereby a first individual condition b1, which states that the traffic heaviness in the first measurement cross-section 6 is greater than a threshold value of 800 vehicles per hour, a second individual condition b2 stating that the speed in the first measurement cross-section 6 is less than the threshold value 30 km/h, a third individual condition b3 stating that the traffic heaviness in the second measurement cross-section 6 is greater than 800 vehicles per hour, and the one individual condition that states that the speed in this second measurement cross-section 8 is less than 30 km/h. If the first and second individual conditions b1, b2 are fulfilled for the first measurement cross-section 6, this corresponds to a peak traffic directed into the city, which is described by the second conditional equation B2. Correspondingly, fulfillment of the third and of the fourth individual condition b3, b4 for the second measurement cross-section 9 means that there is a peak traffic flow coming out of the city, described in the third conditional equation B3 by an AND combination of the third and the fourth individual condition b3, b4. The first conditional equation B1 describes a balanced peak traffic flow, characterized in that all four individual conditions are fulfilled. The conditional equations are stored in a first field of a database data file 15 as a decision table, based in this example on the momentarily switched third situation S3. The possible actions for the signal program selection are thereby stored in a second field of the database data file 15. FIG. 3 concerns a first action A1 in which the fifth situation S5 (balanced peak traffic) is switched, a second action A2 in which the selected signal program for the third situation S3: peak traffic flow into the city is further maintained, a third action A3, in which switching takes place into the fourth situation S4 (peak traffic flow out of the city), and a fourth action in which switching takes place into the second situation S2 (daytime traffic). The selection of the actions A1, A2, A3, A4 takes place with the aid of rules R1 . . . R4, stored in a third field in the database data file 15. The rules R1 to R4 thereby consist of control values and action directions. In each rule a control value is thereby allocated to each condition, which value indicates whether the condition has to assume the truth value 'true Y,' the truth value 'false N' or an arbitrary truth value '–', so that the action corresponding to the action indication is executed. FIG. 3 shows that in the first rule R1 the first conditional equation B1 must receive the truth value 'true Y,' the truth values of the two other conditional equations B2, B3 are not taken into account, and that the action indication X then indicates the first action A1, with which switching takes place into the balanced peak traffic. The second rule specifies that for the case in which the first conditional equation B1 assumes the truth value 'false N,' the second conditional equation B2 assumes the truth value 'true Y,' and the third conditional equation B3 assumes an arbitrary truth value, the action direction X indicates the second action A2, in which the signal program remains switched for the peak traffic directed into the city. The third rule R3 indicates, with its action indication X, the third action A3, in which switching over takes place to the peak traffic flow directed out of the city, if the first and the second conditional equations B1, B2 receive the truth value 'false N' and the third conditional equation B3 receives the truth value 'true Y.' In the fourth rule R4, an action direction X to the fourth action A4 is shown, in which switching takes place into the second situation S2, which action is carried out when all conditional equations B1, B2, B3 receive the truth value 'false N.' In a fourth field, a combination action V is stored that contains further steps that are to be carried out after the executed action. In this example, the processing is terminated by an abort indication E (Exit).

FIG. 4 shows how, by means of combination actions V, a module-type assembling of several database data files D1 . . . D4 is achieved after processing of the actions A1 . . . A4. A fixedly predetermined processing sequence 20 is thereby defined in which the individual database data files D1 . . . D4 are brought into a fixed sequence as a control hierarchy. First a third database data file D3, then a second database data file D2, then a first database data file D1, and finally a fourth database data file 4, are hereby processed. The combination actions V in the individual database data files D1 . . . D4 thereby also permit modification of the fixedly predetermined processing sequence 20. Thus, for example, in the third database data file D3 a possibility of jumping ahead directly to the fourth database data file D4 is represented, and in the second database data file D2 the control program is terminated directly after processing of the second database data file D2, by means of the abort indication E. In the normal case, the database data files D1 . . . D4 are processed in the processing sequence 20, as indicated by the combination action 21 to the address of the subsequent table.

For an adaptation to traffic conditions changed in such a way that they can no longer be controlled within the predetermined context with the aid of the additional signal sequence, in the database data files 15 the conditions, the rules, the actions, the combination actions or the processing sequences are to be adapted if warranted. As indicated in FIG. 3, individual conditions b1, b2, b3, b4 can thereby be combined to form conditional equations by means of Boolean operators. Within the actions, calculations can also be carried out that are accessed in later database data files 15 of a processing sequence 20. By means of the identical structure of different database data files 15, it is also possible to indicate an algorithm that is common for all database data files 15, with which the contents of the database data files 15 are implemented into a traffic-oriented description for the control apparatus 3.

The inventive method can analogously be carried over to traffic management systems in which, on the basis of occupation values, momentary control strategies are replaced by further control strategies that are then realized by means of detour measures, modified indication of alternating traffic signs, or parking space information signs, or by means of radio announcements.

The invention is not limited to the particular details of the method and apparatus depicted and other modifications and applications are contemplated. Certain other changes may be made in the above described method and apparatus without departing from the true spirit and scope of the invention herein involved. It is intended, therefore, that the subject matter in the above depiction shall be interpreted as illustrative and not in a limiting sense.

What is claimed is:

1. A method for traffic-dependent controlling of apparatus for controlling traffic with traffic detectors that detect occupation values in measurement cross-sections in a spatial environment of the apparatus for controlling traffic, having a control apparatus to which occupation values are communicated, which determines from the communicated occupation values, using a control program, prepared characteristic quantities of the traffic sequence for a momentary state of the apparatus for controlling traffic, which compares the prepared characteristic quantities with predetermined threshold values according to predetermined conditional equations, and which determines therefrom, within a predetermined context, a state that is updated in relation to the momentary state, with which the apparatus for controlling traffic is then further operated, comprising the steps of:

the conditional equations in a database data file allocated to the control program;

further actions in the database data file, the further actions defining steps from the momentary state to the updated state;

in the database data file further rules that respectively contain a number of control values corresponding to a number of conditional equations, as well as an action direction, whereby in each rule one of three possible control values is allocated to each conditional equation, which values indicate whether a respective conditional equation has to assume a true truth value, a false truth value, or an arbitrary truth value, so that a respective action of the further actions to which the action direction of the respective rule refers is executed;

comparing the prepared characteristic quantities with predetermined threshold values according to the conditional equations of the database data file, and storing the truth value of a respective conditional equation as a result of the comparison;

comparing the truth values with the control values; and given agreement of the truth values with all control values of an individual rule of the rules, the respective action is executed that is referred to by the action direction of this individual rule.

2. The method for traffic-dependent controlling of apparatus for controlling traffic according to claim 1, wherein the updated state is determined such that the actions comprise combination actions that refer to addresses of further database data files, whereby the database data files are combined with one another in modular fashion.

3. The method for traffic-dependent controlling of apparatus for controlling traffic according to claim 2, wherein by the combination actions, a plurality of database data files are combined in a predetermined processing sequence, whereby a control hierarchy is constructed in which the plurality of database data files are evaluated successively.

4. The method for traffic-dependent controlling of apparatus for controlling traffic according to claim 3, wherein by the combination actions reference is also made to database data files that do not follow directly in the processing sequence, so that the control hierarchy can thereby be modified.

5. The method for traffic-dependent controlling of apparatus for controlling traffic according to claim 3, wherein the actions comprise calculation prescriptions, and wherein during execution of the actions, results are determined based on the calculation prescriptions, and are stored, and wherein the results are taken into account in the conditional equations of database data files that follow in the control hierarchy.

6. The method for traffic-dependent controlling of apparatus for controlling traffic according to claim 1, wherein given an occurrence of traffic flows deviating from the predetermined context such that no updated state is provided, at least one of the conditional equations, the rules and the actions of the database data files are modified, and wherein the modified conditional equations, rules and actions are stored.

7. The method for traffic-dependent controlling of apparatus for controlling traffic according to claim 1, wherein in a traffic signal installation for controlling traffic, a momentary signal program as a momentary state is replaced by a further signal program as an updated state.

8. The method for traffic-dependent controlling of apparatus for controlling traffic according to claim 1 wherein in a traffic management system for controlling traffic, a momentary control strategy as a momentary state is replaced by a further control strategy as an updated state.

9. An apparatus for traffic-dependent controlling of apparatus for controlling traffic, comprising:

traffic detectors that detect occupation values in measurement cross-sections in a spatial environment of the apparatus for controlling traffic;

a control apparatus to which occupation values are communicated, which determines from the communicated occupation values, by a control program, prepared characteristic quantities of the traffic sequence for a momentary state of the apparatus for controlling traffic, which compares these prepared characteristic quantities with predetermined threshold values according to predetermined conditional equations, and which determines therefrom, within a predetermined context, a state that is updated in relation to the momentary state, with which the apparatus for controlling traffic is then further operated;

the control program having database data files with a substantially identical structure of fields;

a first field in which are stored the conditional equations;

a second field in which are stored actions that define steps from the momentary state to the updated state;

a third field in which are stored rules that respectively contain a number of control values corresponding to a number of conditional equations, as well as an action indication, whereby in each rule one of three possible control values is allocated to each conditional equation, which values indicate whether a respective conditional equation has to assume a true truth value, a false truth value, or an arbitrary truth value, so that a respective action to which the action indication of a respective rule refers is executed.

10. The apparatus for traffic-dependent controlling of apparatus for controlling traffic according to claim 9, wherein in the second field, in addition to the respective action, a combination action is stored in a form of an address of a further database data file that is subsequently to be processed.

11. The apparatus for traffic-dependent controlling of apparatus for controlling traffic according to claim 9, wherein in a fourth field a combination action is stored in a form of an address of a further database data file that is subsequently to be processed.

12. The apparatus for traffic-dependent controlling of apparatus for controlling traffic according to claim 9, wherein the conditional equations are composed of individual conditions (b1, b2).

13. The apparatus for traffic-dependent controlling of apparatus for controlling traffic according to claim 12, wherein the individual conditions in the conditional equations are logically combined with one another.

14. The apparatus for traffic-dependent controlling of apparatus for controlling traffic according to claim 9, wherein the apparatus for controlling traffic is a traffic signal installation whose momentary signal sequence as a momentary state is replaced by a further signal sequence as an updated state.

15. The apparatus for traffic-dependent controlling of apparatus for controlling traffic according to claim 9, wherein the apparatus for controlling traffic is a traffic management system, whose momentary control strategy as a momentary state is replaced by a further control strategy as an updated state.

* * * * *